US009486807B2

(12) United States Patent
Barthel et al.

(10) Patent No.: US 9,486,807 B2
(45) Date of Patent: Nov. 8, 2016

(54) SHREDDER WITH INTERACTIVE INTERFACE

(71) Applicant: ACCO Brands Corporation, Lincolnshire, IL (US)

(72) Inventors: Michael R. Barthel, Chicago, IL (US); Brad L. Schantz, Evanston, IL (US)

(73) Assignee: ACCO Brands Corporation, Lake Zurich, IL (US)

( * ) Notice: Subject to any disclaimer, the term of this patent is extended or adjusted under 35 U.S.C. 154(b) by 748 days.

(21) Appl. No.: 13/835,775

(22) Filed: Mar. 15, 2013

(65) Prior Publication Data

US 2014/0263773 A1 Sep. 18, 2014

(51) Int. Cl.

| | |
|---|---|
| ***B02C 25/00*** | (2006.01) |
| ***B02C 18/00*** | (2006.01) |
| *B02C 18/16* | (2006.01) |

(52) U.S. Cl.

CPC ..... *B02C 18/0007* (2013.01); *B02C 18/00* (2013.01); *B02C 25/00* (2013.01); *B02C 2018/164* (2013.01); *B02C 2018/168* (2013.01)

(58) Field of Classification Search

CPC . B02B 18/00; B02C 25/00; B02C 2018/164; B02C 18/0007; B02C 2018/0069; B02C 2018/168; G05B 2219/45044

USPC ..... 241/36, 236, 101.3, 100

See application file for complete search history.

(56) References Cited

U.S. PATENT DOCUMENTS 4,495,456 A * 1/1985 Vercillo ..... H02P 3/20 318/753
5,138,377 A * 8/1992 Smith ..... G03G 15/55 399/11
5,490,089 A * 2/1996 Smith ..... H04N 1/0035 399/77
6,658,218 B2 * 12/2003 Krolczyk ..... B65H 43/00 399/16
7,766,266 B2 * 8/2010 Huang ..... B02C 18/0007 241/100
8,091,809 B2 * 1/2012 Hu ..... B02C 18/0007 241/100
2005/0015682 A1 * 1/2005 Colucci ..... G06F 11/328 714/47.1
2006/0016919 A1 * 1/2006 Castronovo ..... B02C 18/0007 241/34
2008/0047448 A1 * 2/2008 Cocklin ..... G03G 15/70 101/483
2009/0121057 A1 * 5/2009 Brown, Sr. ..... B02C 18/0007 241/62
2010/0091103 A1 * 4/2010 Peltonen ..... B02C 21/02 348/82
2010/0181398 A1 * 7/2010 Davis ..... B02C 18/0007 241/36
2010/0243774 A1 * 9/2010 Hu ..... B02C 18/0007 241/30
2012/0111979 A1 * 5/2012 Jensen ..... B02C 18/0007 241/25

FOREIGN PATENT DOCUMENTS

CN 103301925 A 9/2013
JP 2006181478 A 7/2006

OTHER PUBLICATIONS

Fellowed, Inc. Powershred 79Ci Manual. Dec. 2011. pp. 3-4.*

(Continued)

*Primary Examiner* — Mark Rosenbaum
(74) *Attorney, Agent, or Firm* — Michael Best & Friedrich LLP

(57) ABSTRACT

A shredder includes a cutting mechanism operable to shred material fed thereto. A controller is coupled to the cutting mechanism to control the on/off state and the direction of rotation of the cutting mechanism. An interactive user interface is coupled to the controller. The controller is configured to detect a jammed condition within the shredder and communicate a series of instructions to the interactive user interface to instruct the user how to clear the jam.

20 Claims, 9 Drawing Sheets

(56) References Cited
OTHER PUBLICATIONS

Swingline. Stack-and-Shred 300X and 300M Shredders, Aug. 2013. p. 9.*
UK IPO Search Report for GB Appl. No. 1404095.0 dated Sep. 25, 2014, 3 pages.
ACCO Brands Europe, Rexel Auto+ 250X Instruction Manual, Jun. 2012, p. 6; Issue 2, http://accoblobstorageus.blob.core.windows.net/literature/3064c64e-bdea-40dd-9697-cd24c62e9f88.pdf.
ACCO Brands Europe, Rexel Mercury REM723, RES1223 & REX1023 Instruction Manual, Jan. 2012, p. 5; Issue 3, http://accoblobstorageus.blob.core.windows.net/literature/1009.pdf.
ACCO Brands Europe, Rexel Mercury RSS1627 & RSX1227 Instruction Manual, Feb. 2008, p. 5; Issue 2, http://accoblobstorageus.blob.core.windows.net/literature/90.pdf.

* cited by examiner

SHREDDER WITH INTERACTIVE INTERFACE

BACKGROUND

The present invention relates to shredding machines ("shredders"), for example those used in homes and offices for destroying sensitive or confidential materials, including paper documents, compact discs, credit cards, etc. Certain circumstances can result in a jam, wherein material being processed through the cutters of the shredder is not able to be fully processed in continuous forward operation. Some users may be aware that running the shredder back-and-forth between forward and reverse operation can potentially clear a jam, but others may not. Even if a user is compelled to run the shredder back-and-forth between forward and reverse operation, they may be uncertain as to how long to run in each direction, or when to change directions,

SUMMARY

In one aspect, the invention provides a shredder including a cutting mechanism operable to shred material fed thereto. A controller is coupled to the cutting mechanism to control the on/off state and the direction of rotation of the cutting mechanism. An interactive user interface is coupled to the controller. The controller is configured to detect a jammed condition within the shredder and communicate a series of instructions to the interactive user interface to instruct the user how to clear the jam.

In another aspect, the invention provides a method of controlling a shredder. A jammed condition within the shredder is identified. A series of interactive instructions are communicated to a user via a user interface of the shredder to instruct the user how to clear the jam.

Other aspects of the invention will become apparent by consideration of the detailed description, and accompanying drawings.

DETAILED DESCRIPTION

Figure 1:
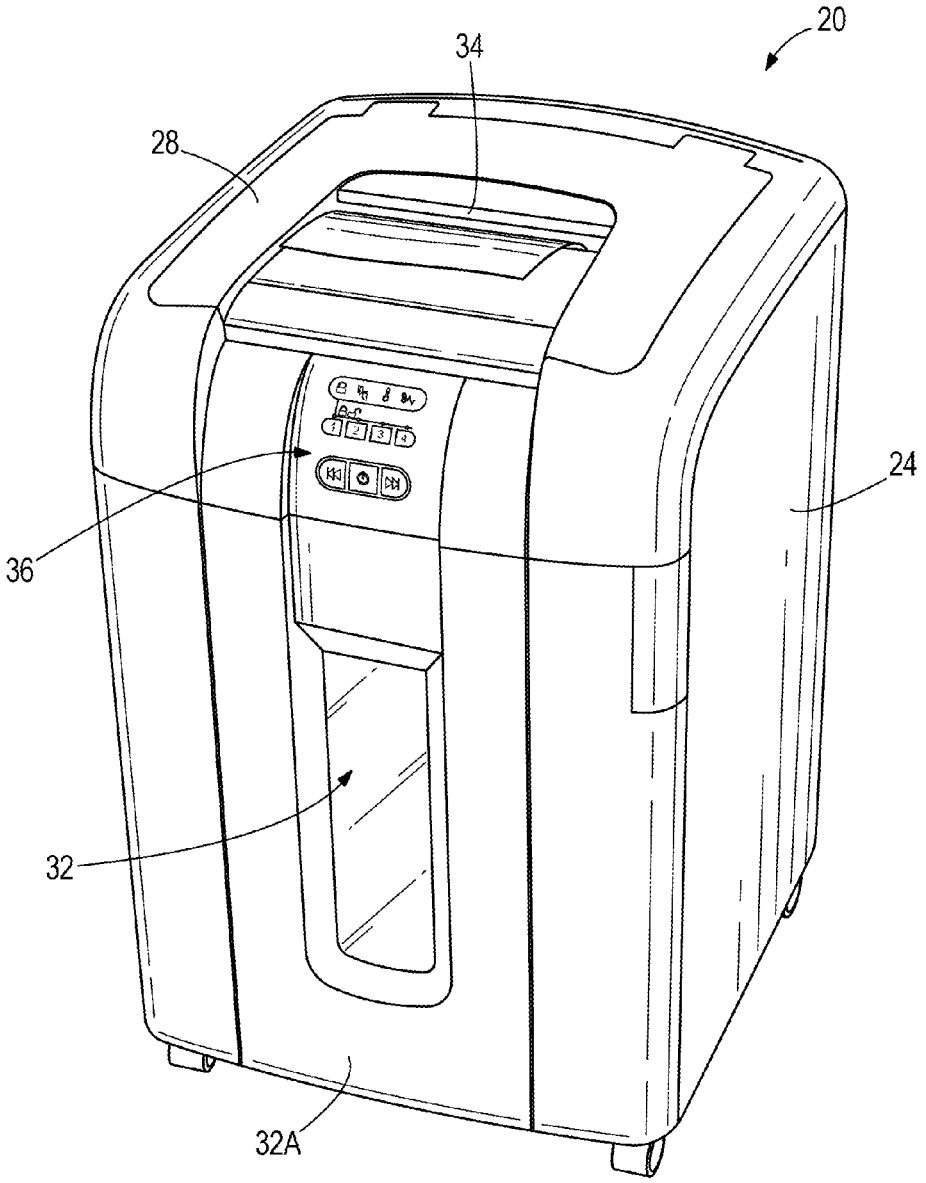
FIG. 1 is a perspective view of a first shredder, an auto-feed shredder, according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways, FIG. 1 illustrates a shredding machine 20 of a first construction, which is an auto-feed shredder. The shredder 20 includes a housing 24 defining an enclosure within which a cutting mechanism 64 (FIG. 2) is positioned. The cutting mechanism 64 can include a set of parallel shafts with interleaved cutting blades, or another type of cutting mechanism configured to cut up material such as paper, credit cards, etc. fed therein. The cutting mechanism 64 is drivable by one or more electric motors, or another drive source, to operate in a forward (shredding) direction, and alternately, in a reverse direction. With the auto-feed shredder 20, material to be shredded is placed into a tray or bin by lifting a lid or access door 28 of the housing 24. The lid 28 can be lockable to prevent unauthorized access to the material deposited into the auto-feed tray. A feed mechanism automatically delivers the material from the auto-teed tray to the cutting mechanism 64. Once shredded, the material is delivered from the cutting mechanism 64 to a collection bin 32. In some constructions, the collection bin 32 is accessed by a door 32A of the housing 24. Although the shredder 20 has auto-feed capability, a manual feed slot 34 is also provided, which bypasses the auto-feed tray to deliver material directly to the cutting mechanism 64 as manually inserted by a user.

Figure 2:
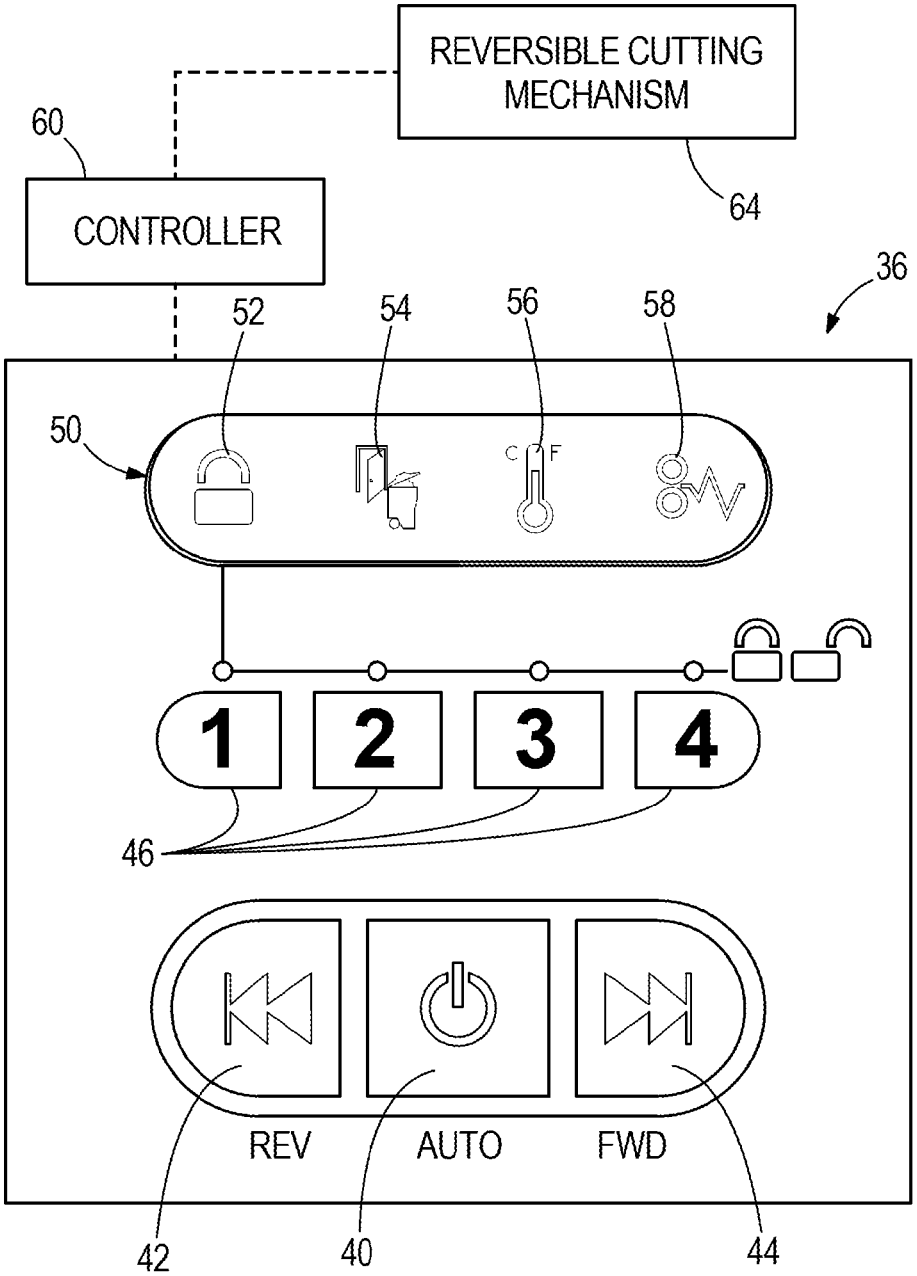
FIG. 2 is a front view of an interactive user interface of the shredder of FIG. 1.

On a front or top side of the shredder 20, an interactive user interface 36 is provided. FIG. 2 provides a detail view of the interactive user interface 36. The interface 36 includes a plurality of visual indicators (e.g., lights, icons, etc.) and a plurality of user-operable controls. The controls include a power/auto control 40, a reverse direction control 42, a forward direction control 44, and a series of PIN-code entry controls 46. In the illustrated construction, each of the controls 40, 42, 44, 46 is provided by an individual push-button. In other constructions, the controls may be provided by other types of controls, including multi-function switches, slider switches, rocker switches, dials, etc. The interface 36 further includes a display 50 having a plurality of illuminable indicators, which in the illustrated construction include a first icon 52 for indicating a locked condition of the lid 28, a second icon 54 for indicating that the collection bin door 32A is open, a third icon 56 for indicating overheating of the motor that drives the cutting mechanism 64, and a fourth icon 58 for indicating that a jam has occurred in the cutting mechanism 64. Further indicators are provided by lighting associated with one or more of the user controls 40, 42, 44, 46. In the illustrated construction, this includes lighting configured to illuminate (e.g., backlight) each of the individual push-buttons 40, 42, 44, 46 directly. In other constructions, lighting associated with the user controls 40, 42, 44, 46 can include lighting adjacent one or more of the user controls 40, 42, 44, 46. Adjacent lighting can take the form of a simple light source (e.g., LED), or lighting (e.g., backlighting) of a label such as a picture, symbol, word, etc. associated with one or more of the user controls 40, 42, 44, 46. As shown schematically in FIG. 2, the interactive user interface 36 is coupled to a controller 60, which is coupled to the cutting mechanism 64.

Figure 3:
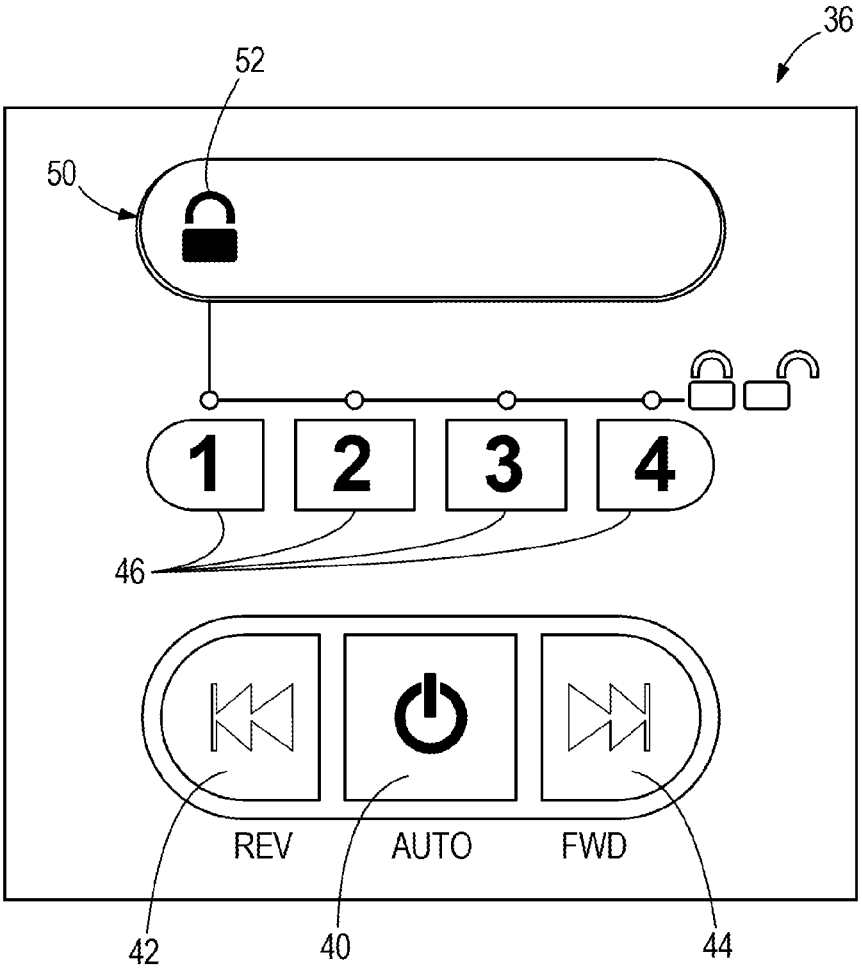
FIG. 3 is a front view of the interactive user interface of FIG. 2, with a power/auto button illuminated.

When the shredder 20 is off, actuation of the power/auto control 40 turns the shredder on and puts the shredder into an automatic or "auto" mode in which the cutting mechanism 64 is operated automatically in response to the presence of paper or other material to be shredded. During shredding in the auto mode, a user is not required to actuate either of the reverse or forward direction controls 42, 44, and the shredder 20 will simply run in the forward shredding direction as long as material is present to shred. The power/auto control 40 may be illuminated (e.g., blue backlighting) whenever the shredder 20 is on (FIG. 3).

During normal shredding in the auto mode, a jam may occur due to a variety of circumstances. For example, the cutting mechanism 64 may become physically jammed (i.e., obstructed or locked-up) when especially tough material and/or sheets of paper containing one or more staples or paper clips present a load to the cutting mechanism 64 above a predetermined threshold load. The detection of this type of jam may be determined by measuring electric current to the motor that drives the cutting mechanism 64. Other factors may also be used in determining that a jam has occurred, in cooperation with motor current or in lieu thereof. For example, a sensor may detect that the rotation of the cutting mechanism 64 has slowed down below a predetermined speed or has stopped. Furthermore, a jammed condition may be defined by detection of material feeding malfunction or slippage by which material is not being successfully passed though the cutting mechanism 64, even though the cutting mechanism 64 is running or operating normally. For example, the controller 60 can identify that the load on the cutting mechanism 64 is below a threshold value, corresponding to no material presence, while simultaneously identifying that material to be shredded remains present at an inlet of the shredder, via a sensor (e.g., a mechanical switch or optical sensor) that detects material presence. This can occur particularly in auto-feed shredders, for example when especially glossy or slick materials are loaded into the auto-feed tray. However, it is also possible under certain circumstances in manual shredders (e.g., when refuse builds up adjacent an outlet of the cutting mechanism in a strip cut type shredder). Thus, a jammed condition may be broadly defined as a circumstance where material presented to the shredder 20 ceases to be successfully processed though the cutting mechanism 64 with the shredder in an operational mode.

Upon detecting that a jam has occurred, in addition to notifying the user by illuminating the jam icon 58, the controller 60 controls the interactive user interface 36 to guide the user through a series of steps for clearing the jam. In some constructions, especially those in which the shredder 20 is an auto-feed shredder, the controller 20 may only use the interface 36 to guide the user through a jam-resolving or jam-clearing process after first running an automatic jam clearing process that has not resulted in clearance of the jam.

When the controller 60 determines that user interaction is needed to clear a jam, the controller 60 sequentially instructs the user to operate the direction controls 42, 44 to perform a jam clearing procedure. The first step can be to prompt the user to operate the reverse direction control 42 (e.g., when a physical jam of the cutting mechanism 64 is identified) or to prompt the user to operate the forward direction control 44 (e.g., when paper slippage is identified). Although the remaining description focuses on the scenario of a physical jam of the cutting mechanism 64, in which reverse is the first prompted direction, it will be understood that the operation can simply be switched so that the sequential instructions begin with forward, followed by reverse.

Figure 4:
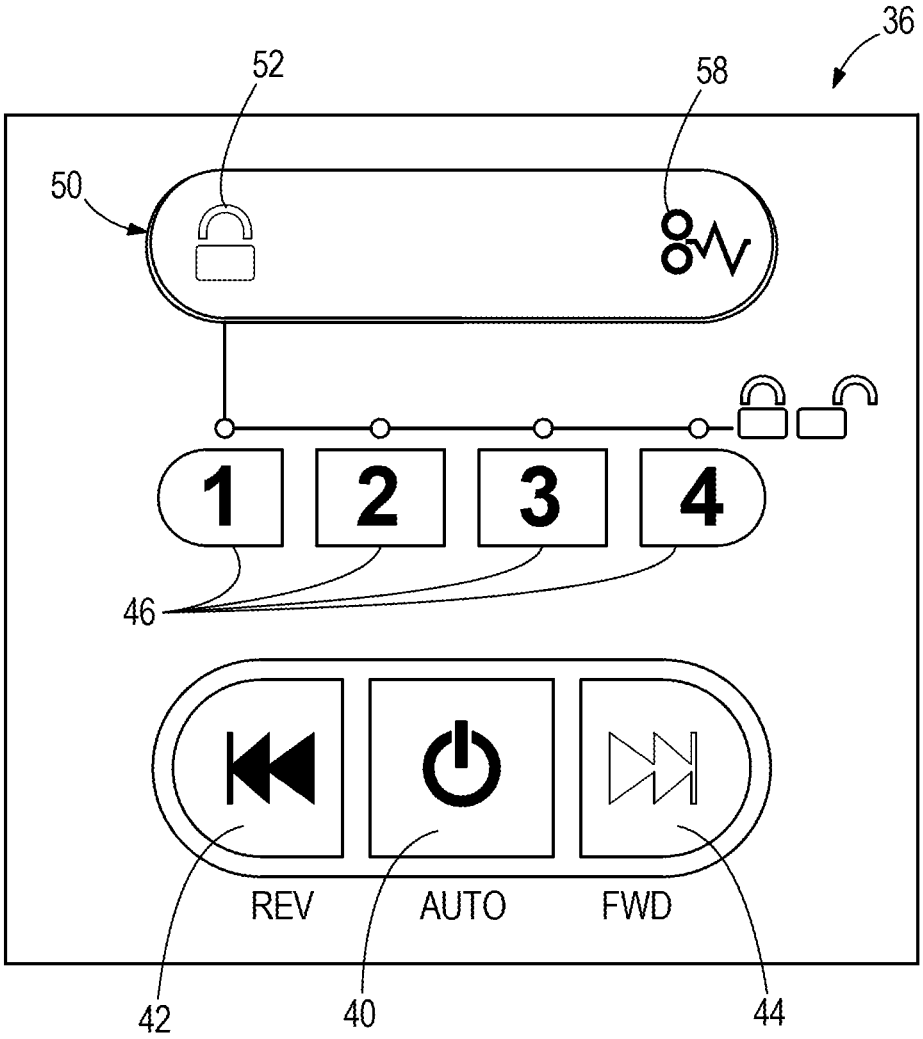
FIG. 4 is a front view of the interactive user interface of FIG. 2, with a jam icon and reverse direction control
Figure 5:
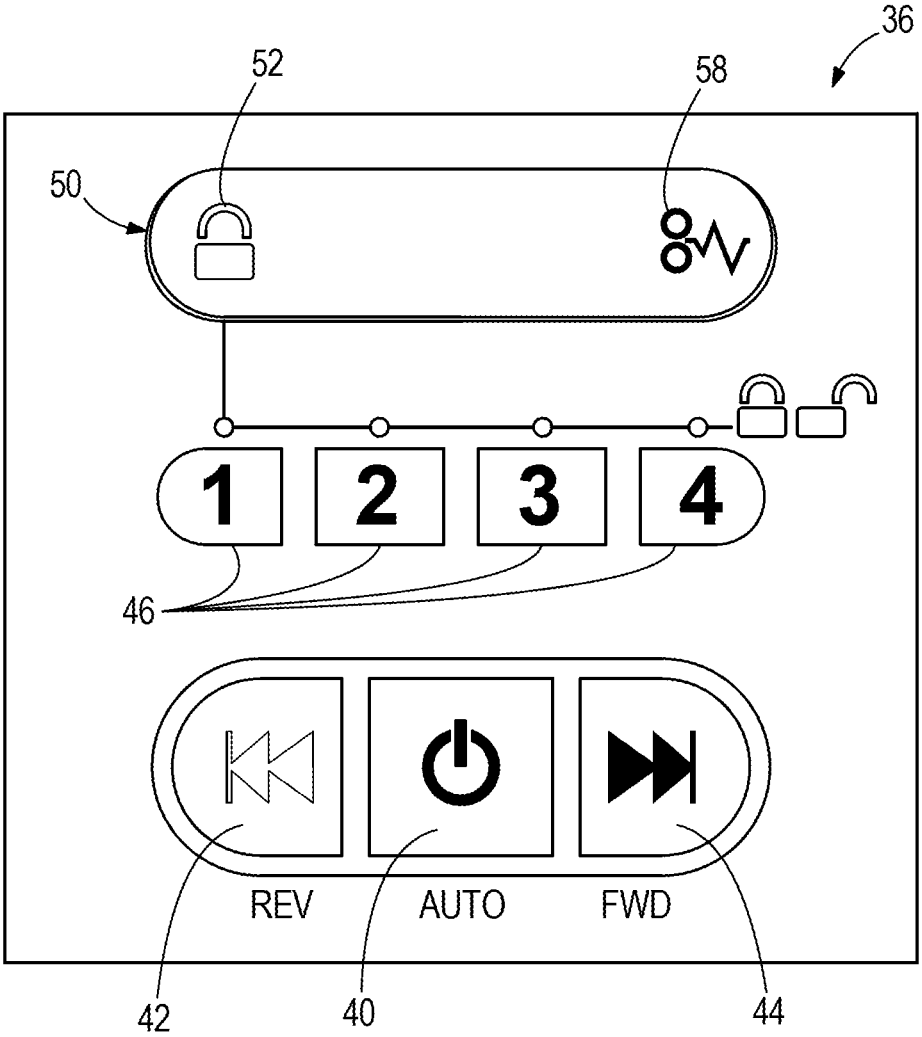
FIG. 5 is a front view of the interactive user interface of FIG. 2, with a jam icon and forward direction control illuminated.

Prompting the user to actuate the reverse direction control 42 can be done by illuminating both the jam icon 58 (e.g., red backlighting) and the lighting associated with the reverse direction control 42 (e.g., red backlighting, FIG. 4). In some constructions, both the jam icon 58 and the lighting of the reverse direction control 42 are controlled to flash, and may be flashed in unison or in an alternating fashion. This sends a clear message to the user that they should actuate the reverse direction control 42 due to the occurrence of a jam. When flashing in unison, the interface 36 toggles between the state of FIG. 4 and the state of FIG. 3. In other constructions, such as a shredder without a jam icon, only the lighting associated with the reverse direction control 42 may be illuminated. Once the user actuates the reverse direction control 42, whether momentary or prolonged, the controller 60 is configured to operate the cutting mechanism 64 in the reverse direction for a predetermined period of time (e.g., 3 to 10 seconds). The lighting associated with the reverse direction control 42 may be steadily illuminated (without flashing) during the predetermined period of time. The jam icon 58 may continue to flash. After the predetermined period of time has elapsed, the controller 60 prompts the user to operate the forward direction control 44. This can be done by illuminating the lighting associated with the forward direction control 44 (e.g., red backlighting), and optionally illuminating the jam icon 58 (e.g., red backlighting) as shown in FIG. 5. In some constructions, both the jam icon 58 and the lighting associated with the forward direction control 44 are controlled to flash, and may be flashed in unison or in an alternating fashion. This sends a clear message to the user that they should actuate the forward direction control 44 to clear the jam. When flashing in unison, the interface 36 toggles between the state of FIG. 5 and the state of FIG. 3. Once the user actuates the forward direction control 44, whether momentary or prolonged, the controller 60 is configured to operate the cutting mechanism 64 in the forward direction until either all the material present has run successfully through the cutting mechanism 64 and the absence of material is detected, or until another jam is detected. The lighting associated with the forward direction control 44 may be steadily illuminated (without flashing) while the cutting mechanism 64 operates in the forward direction. The jam icon 58 may continue to flash unless the forward operation of the cutting mechanism 64 is determined to have cleared the jam.

Figure 6:
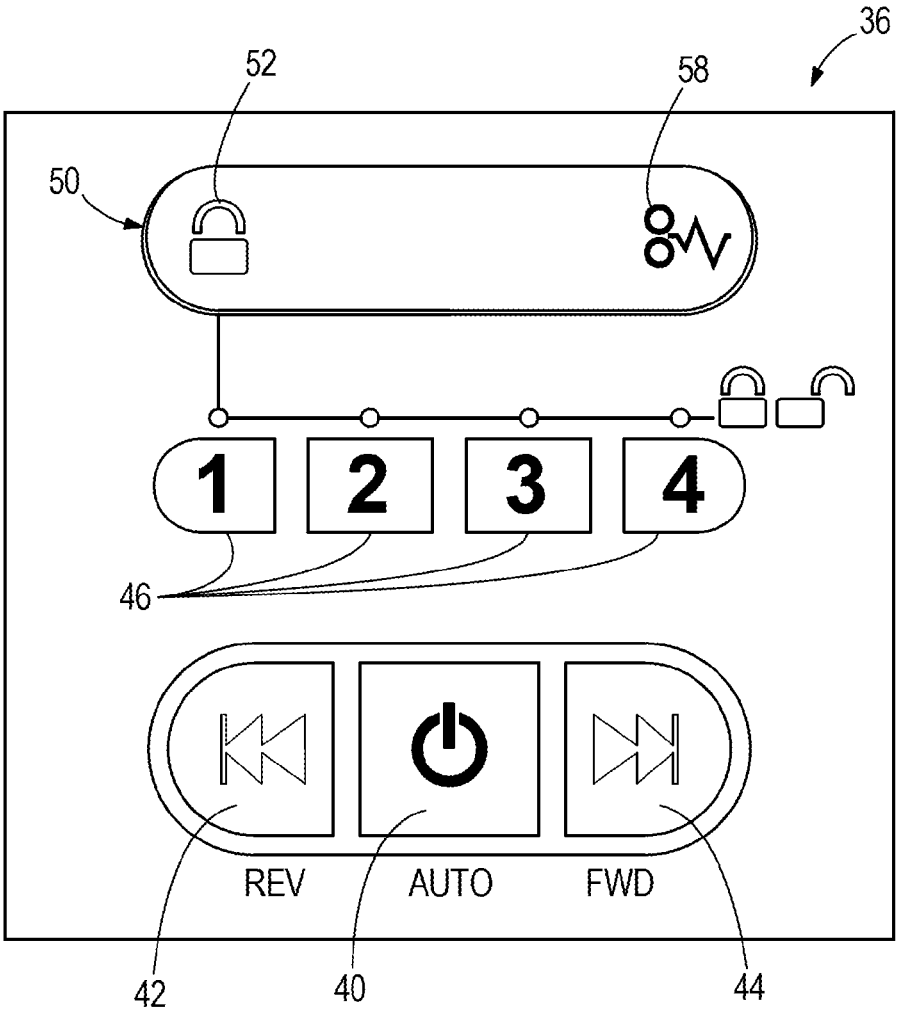
FIG. 6 is a front view of the interactive user interface of FIG. 2, with a jam icon illuminated.

If the jam is determined to be cleared, illumination of the jam icon 58 and the forward direction control 44 ceases, and the shredder 20 returns to auto mode, or "resets". This may occur after a predetermined amount of time passes during continued forward operation of the cutting mechanism 64 or a predetermined amount of rotation of the cutting mechanism 64 has occurred (e.g., corresponding to passage of at least one full sheet of paper of a predetermined size). The shredder 20 may also reset upon opening of the lid 28 or another part of the shredder. On the other hand, if another jam is detected before the reset, the controller 60 directs instructions for another user-operated reverse-forward cycle. In other words, the controller 60 repeats the reverse prompt, reverse running for a predetermined time, followed by the forward prompt, and forward running until clear or another jam. The controller 60 may be configured to prompt only a predetermined number of reverse-forward cycles (e.g., 3-5 cycles) by the user before ceasing and indicating that the jam should be cleared manually. For example, the jam icon 58 may be illuminated, steadily or flashing, without illumination of either of the reverse and forward direction controls 42, 44 as shown in FIG. 6. The jam icon 58 may be illuminated in a different color to indicate that the jam requires manual clearing.

Figure 7:
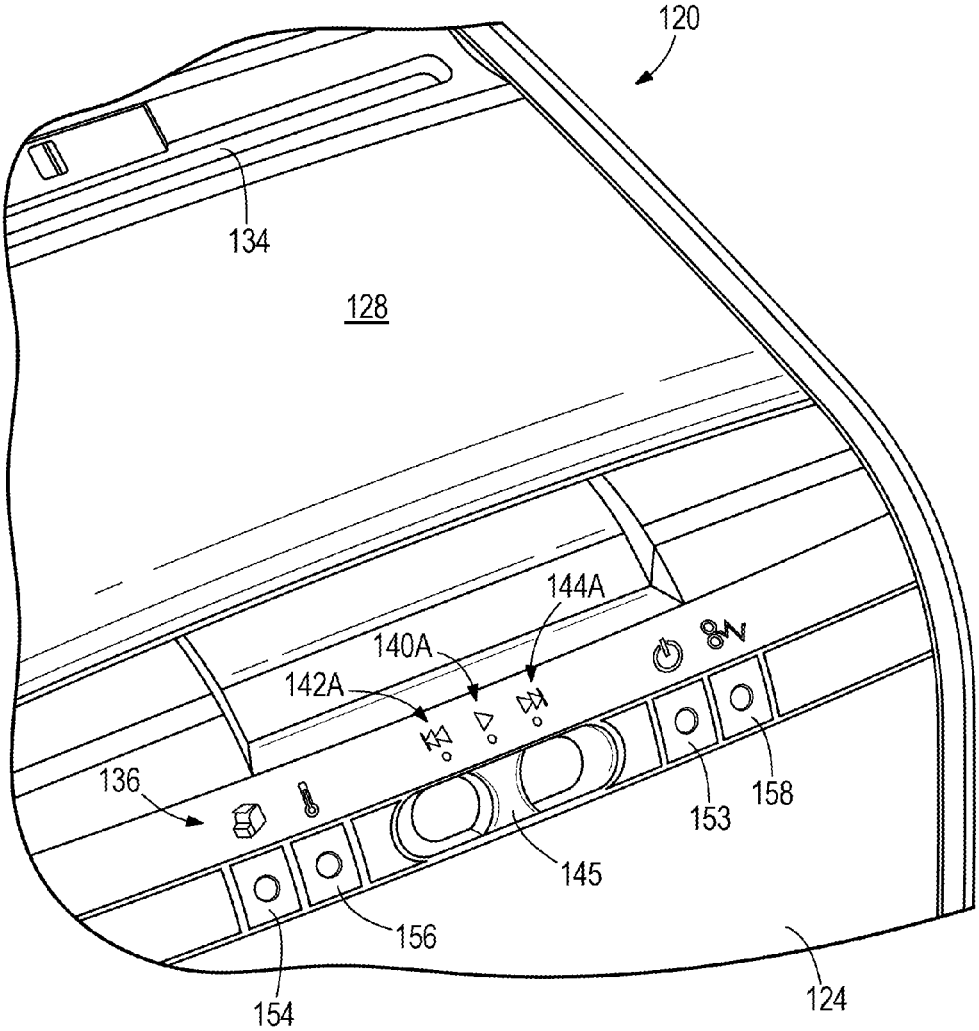
FIG. 7 is a perspective view of a second shredder, an auto-feed shredder, according to one embodiment of the invention.

FIG. 7 illustrates a shredder 120 of an alternate construction, having features similar to the shredder 20 described above and illustrated in FIGS. 1-6. The shredder 120 has a housing 124 enclosing a cutting mechanism (not shown) drivable in forward and reverse directions by an electric motor) under direction of a controller. A lid 128 provides access to an auto-feed tray, and a manual feed slot 134 is also provided at a top of the housing 124 behind the lid 128. Operation of the shredder 120, including the controller-prompted user instructions for unjamming, are generally similar to that described above with reference to the shredder 20. However, the shredder 120 includes an interactive user interface 136 having a different construction than the interface 36 of the shredder 20.

The interactive user interface 136 includes a multi-position actuator 145 (e.g., slider switch), operable by the user for controlling the drive mode of the cutting mechanism. The multi-position actuator 145 has a first position (e.g., center position) for the auto mode, a second position (e.g., left position) for reverse direction control, and a third position (e.g., right position) for forward direction control. Although the multi-position actuator 145 can be configured to have embedded or integral indicators (e.g., lighting such as LED lighting), the interface 136 of the shredder 120 is provided with separate indicators adjacent the multi-position actuator 145. For example, just above the multi-position actuator 145, an auto drive indicator 140A is provided in a central position, a reverse drive indicator 142A is provided in a left position, and a forward drive indicator 144A is provided in a right position. Each of the indicators 140A, 142A, 144A can include a picture, symbol, word, and/or light (e.g., LED and/or LED backlighting). As illustrated, each of the indicators 140A, 142A, 144A includes a non-illuminating symbol and a light (e.g., LED). In other constructions, the symbols themselves may be illuminated and a separate light may or may not be provided. Similar to the indicators 140A, 142A, 144A, additional indicators are provided within the interactive user interface 136. These can include a power indicator 153, a door-ajar indicator 154 for indicating that at least one of the lid 128 and a collection bin door is open, an overheat indicator 156 for indicating overheating of the motor that drives the cutting mechanism, and a jam indicator 158 for indicating that material has become jammed. Each of the indicators 153, 154, 156, 158 includes a picture, symbol, or word and an adjacent light (e.g., LED), but other configurations such as illuminated pictures, symbols, or words are optional.

The operation of the shredder 120, as directed by the controller, is similar to that described above with respect to the shredder 20. For example, the controller can provide sequential instruction to the user via the interactive user interface 136 to prompt the user to actuate the controls (multi-position actuator 145) of the interface 136 to carry out an unjamming sequence or process. Without fully repeating the operation, it will be understood that the shredder 120 is similarly configured to the shredder 20 except for the particular construction of the user controls and the indicators. When the controller detects a jam, the jam indicator 158 is illuminated, much like the jam icon 58 of the shredder 20. To prompt the user to move the multi-position actuator 145 to the reverse position, the controller is configured to illuminate flash) both the jam indicator 158 and the reverse drive indicator 142A. To prompt the user to move the multi-position actuator 145 to the forward position, the controller is configured to illuminate (e.g., flash) both the jam indicator 158 and the forward drive indicator 144A.

Figure 8:
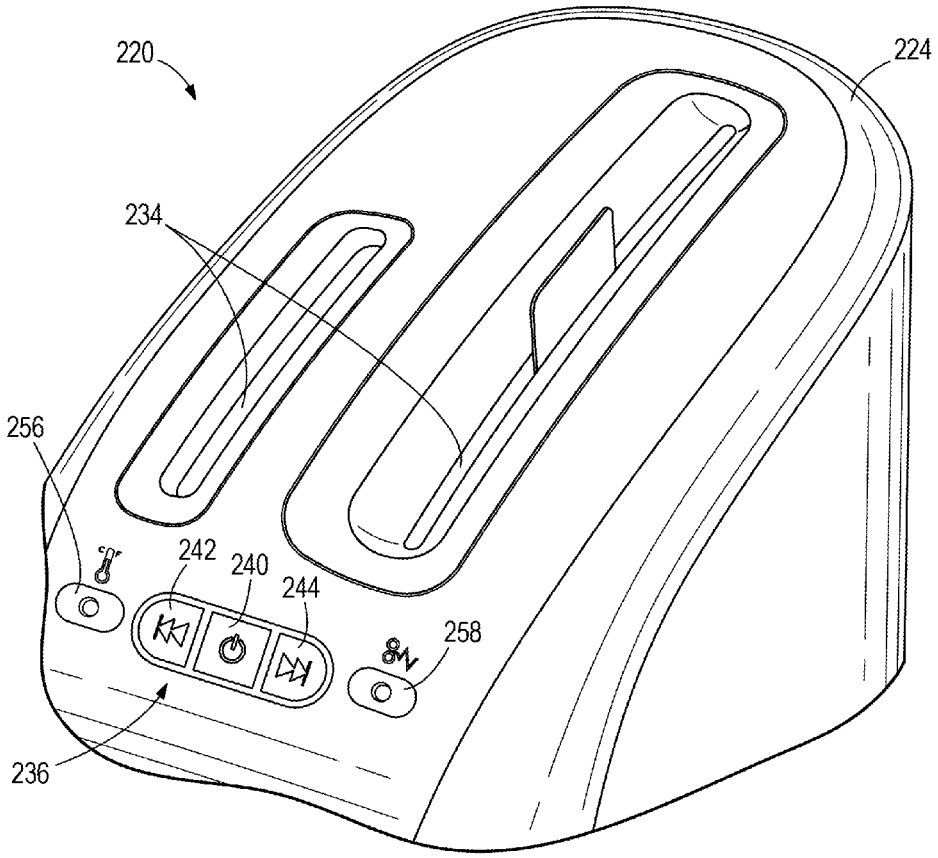
FIG. 8 is a perspective view of a third shredder, a manual feed shredder, according to one embodiment of the invention.

FIG. 8 illustrates yet another shredder 220 of an alternate construction, having features similar to the shredders 20, 120 described above and illustrated in FIGS. 1-7. The shredder 220 has a housing 224 enclosing a cutting mechanism (not shown) drivable in forward and reverse directions (e.g., by an electric motor) under direction of a controller. The shredder 220 is a manual feed shredder and has a pair of manual feed slots 234, but no lid for accessing an auto-feed tray. Operation of the shredder 220, including the controller-prompted user instructions for unjamming, are generally similar to that described above with reference to the shredder 20 and the shredder 120. However, the shredder 220 includes an interactive user interface 236 having a different construction than the interfaces 36, 136 of the shredders 20, 120.

The interactive user interface 236 includes individual user controls for power/auto 240, reverse direction 242, and forward direction 244. Each of these controls 240, 242, 244 can include embedded or integral indicators (e.g., backlighting) similar to the controls 40, 42, 44 of the shredder 20. However, rather than the display 50 with illuminable icons, the interface 236 of the shredder 220 includes indicators similar to those of the shredder 120. For example, the interface 236 includes an overheat indicator 256 for indicating overheating of the motor that drives the cutting mechanism, and a jam indicator 258 for indicating that material has become jammed in the cutting mechanism. Each of the indicators 256, 258 includes a picture, symbol, or word and an adjacent light (e.g., LED), but other configurations such as illuminated pictures, symbols, or words are optional.

The operation of the shredder 220, as directed by the controller, is similar to that described above with respect to the shredder 20. For example, the controller can provide sequential instruction to the user via the interactive user interface 236 to prompt the user to actuate the reverse and forward direction controls 242, 244 of the interface 236 to carry out an unjamming sequence or process. Without fully repeating the operation, it will be understood that the shredder 220 is similarly configured to the shredder 20 except for the particular construction of the indicators, and the absence of auto-feed capability. When the controller detects a jam, the jam indicator 258 is illuminated, much like the jam icon 58 of the shredder 20. To prompt the user to operate the reverse position control 242, the controller is configured to illuminate (e.g., flash) both the jam indicator 258 and the reverse drive control 242. To prompt the user to operate the forward direction control 244, the controller is configured to illuminate (e.g., flash) both the jam indicator 258 and the forward drive control 244. The controller of the shredder 220 does not carry out any automatic jam clearing procedure prior to prompting the user-actuated unjamming sequence.

Figure 9:
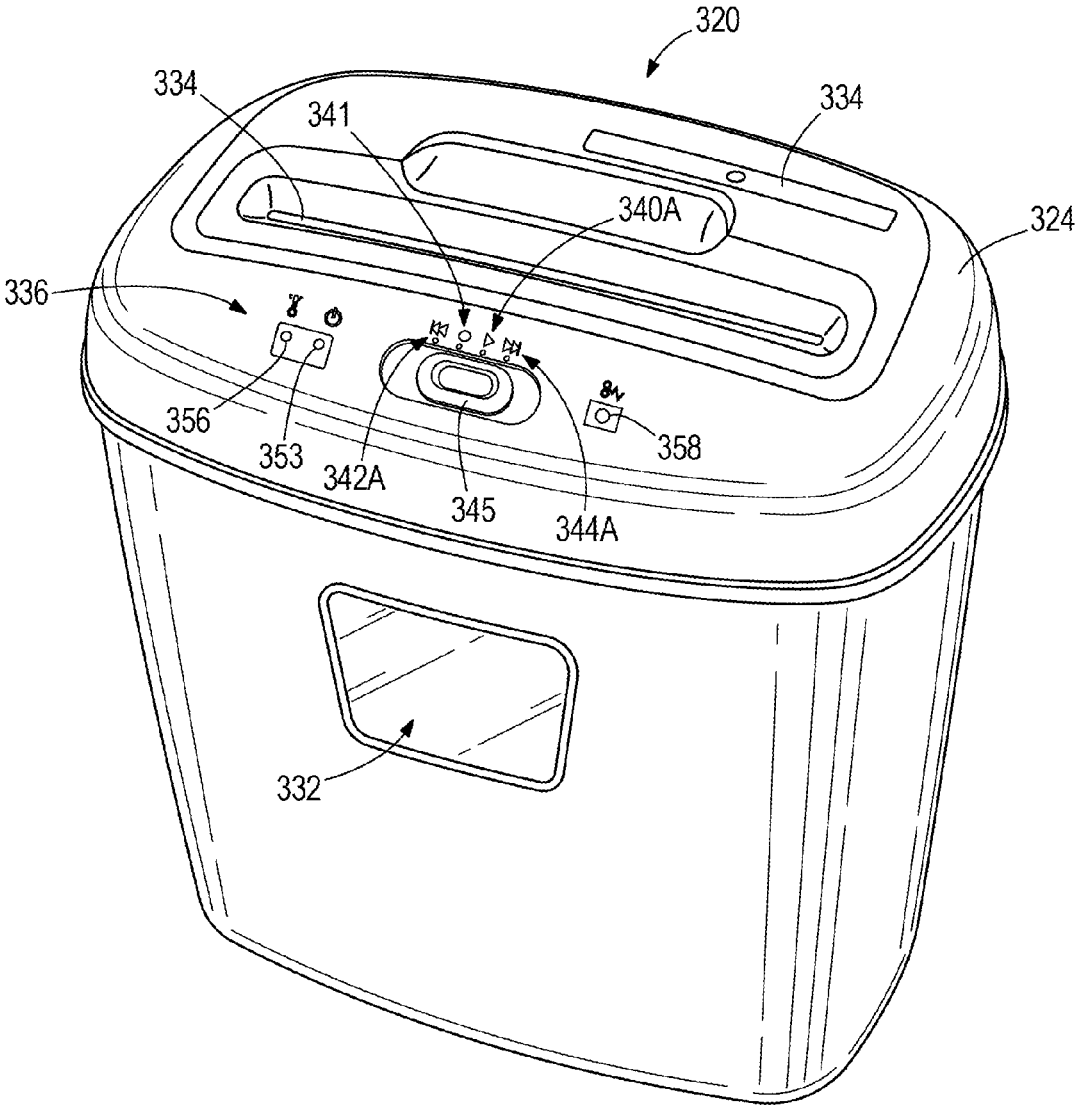
FIG. 9 is a perspective view of a third shredder, a manual feed shredder, according to one embodiment of the invention.

FIG. 9 illustrates a shredder 320 of an alternate construction, having features similar to the shredders 20, 120, 220 described above and illustrated in FIGS. 1-8. The shredder 320 has a housing 324 enclosing a cutting mechanism (not shown) drivable in forward and reverse directions (e.g., by an electric motor) under direction of a controller and has a collection bin 332 to receive shredded material. The shredder 320 is a manual feed shredder, similar to the shredder 220 of FIG. 8, having a pair of manual feed slots 334, but no lid for accessing an auto-feed tray. However, the shredder 320 includes an interactive user interface 336 generally similar to the interface 136 of the auto-feed shredder 120 of FIG. 7, rather than the interface 236 of the manual-feed shredder 220 of FIG. 8. The interactive user interface 336 includes a multi-position actuator 345 (e.g., slider switch), operable by the user for controlling the drive mode of the cutting mechanism. The multi-position actuator 345 has a first position for the auto mode, a second position (e.g., left of the first position) for turning the shredder 320 off, a third position (e.g., left-most position) for reverse direction control, and a fourth position (e.g., right-most position) for forward direction control. Although the multi-position actuator 345 can be configured to have embedded or integral indicators (e.g., lighting such as LED lighting), the interface 336 of the shredder 320 is provided with separate indicators adjacent the multi-position actuator 345. For example, just above the multi-position actuator 345, an auto drive indicator 340A and an off indicator 341 are provided between a reverse drive indicator 342A in a left position, and a forward drive indicator 344A in a right position. Each of the indicators 340A, 341, 342A, 344A can include a picture, symbol, word, and/or light (e.g., LED and/or LED backlighting). As illustrated, each of the indicators 340A, 341, 342A, 344A includes a non-illuminating symbol and a light (e.g., LED). In other constructions, the symbols themselves may be illuminated and a separate light may or may not be provided. Similar to the indicators 340A, 341, 342A, 344A, additional indicators are provided within the interactive user interface 336. These can include a power indicator 353, an overheat indicator 356 for indicating overheating of the motor that drives the cutting mechanism, and a jam indicator 358 for indicating that material has become jammed in the cutting mechanism. Each of the indicators 353, 356, 358 includes a picture, symbol, or word and an adjacent light (e.g., LED), but other configurations such as illuminated pictures, symbols, or words are optional.

The operation of the shredder 320, as directed by the controller, is similar to that described above with respect to the shredder 20. For example, the controller can provide sequential instruction to the user via the interactive user interface 336 to prompt the user to actuate the controls (multi-position actuator 345) of the interface 336 to carry out an unjamming sequence or process. Without fully repeating the operation, it will be understood that the shredder 320 is similarly configured to the shredder 20 except for the particular construction of the user controls and the indicators. When the controller detects a jam, the jam indicator 358 is illuminated, much like the jam icon 58 of the shredder 20. To prompt the user to move the multi-position actuator 345 to the reverse position, the controller is configured to illuminate flash) both the jam indicator 358 and the reverse drive indicator 342A. To prompt the user to move the multi-position actuator 345 to the forward position, the controller is configured to illuminate (e.g., flash) both the jam indicator 358 and the forward drive indicator 344A.

Although the interfaces of the various shredders disclosed herein use illumination of lighting or icons as visual indicators, other types of indicators may be provided and controlled by the controller in a similar manner. For example, the lighting associated with one or more direction controls may be illuminated in a normal (not jammed) operating mode of the shredder, and a change in the illumination (e.g., change in intensity, changing from solid to flashing, change of color, etc.) may be used as notification to the user for prompting user actuation of the reverse and forward controls, in addition to or in lieu of the various indicators described above, a screen (e.g., LCD screen) may be provided in the shredder housing and configured to display text and/or symbolic instructions as notification to the user tier prompting user actuation of the reverse and forward controls. For example, the screen could display a message reading, "JAM HAS OCCURRED, PLEASE REVERSE" or "JAM HAS OCCURRED, PRESS ◀◀" followed by "PRESS ▶▶".

Various features and advantages of the invention are set forth in the following claims.

What is claimed is:

1. A shredder comprising:

a cutting mechanism operable to shred material fed thereto;

a controller coupled to the cutting mechanism to control the on/off state and the direction of rotation of the cutting mechanism; and an interactive user interface coupled to the controller, wherein the controller is configured to detect a jammed condition within the shredder and communicate a series of instructions to the interactive user interface to instruct the user how to clear the jam, wherein the controller is operable to provide an instruction via the interactive user interface to operate a reverse direction control, wherein the controller is operable to run the cutting mechanism in reverse for a predetermined period of time following user actuation of the reverse direction control, and wherein the controller is operable to provide an instruction via the interactive user interface, after the predetermined time period has expired, to operate a forward direction control.

2. The shredder of claim 1, wherein, upon user actuation of the forward direction control, the controller is configured to operate the cutting mechanism in the forward direction until the material is fully passed through the cutting mechanism or another jam is detected.

3. The shredder of claim 2, wherein the controller is configured to prompt a predetermined number of user-actuated directional operations of the cutting mechanism, and if the jam is not cleared, to indicate to the user that the jam must be manually cleared.

4. The shredder of claim 1, wherein the controller is configured to provide continuous illumination of lighting associated with the reverse direction control during the predetermined period of time, and to flash lighting associated with the forward direction control upon expiry of the predetermined period of time.

5. The shredder of claim 1, wherein the reverse and forward direction controls are provided by individual push-buttons.

6. The shredder of claim 1, wherein the reverse and forward direction controls are provided by a common multi-position actuator.

7. The shredder of claim 1, wherein the controller illuminates a jam icon and lighting associated with the reverse direction control to instruct the user to operate the reverse direction control.

8. The shredder of claim 7, wherein the controller is configured to flash both the jam icon and lighting associated with the reverse direction control to instruct the user to operate the reverse direction control.

9. The shredder of claim 8, wherein the controller is configured to flash both the jam icon and lighting associated with the forward direction control to instruct the user to operate the forward direction control.

10. The shredder of claim 1, wherein the controller is configured to detect the jammed condition by identifying a load on the cutting mechanism in excess of a threshold.

11. The shredder of claim 1, wherein the controller is configured to detect the jammed condition by concurrently identifying material presence and a load on the cutting mechanism below a threshold.

12. A method of controlling a shredder including a cutting mechanism, the method comprising:

identifiying a jammed condition within the shredder; and communicating a series of interactive instructions to a user via a user interface of the shredder to instruct the user how to perform a jam clearing procedure, wherein communicating the series of interactive instructions includes instructing the user via the user interface to operate a reverse direction control, and instructing the user via the user interface to operate a forward direction control, wherein the instruction to operate the forward direction control is communicated in response to the cutting mechanism operating in reverse for a predetermined period of time following user actuation of the reverse direction control.

13. The method of claim 12, further comprising, upon user actuation of the forward direction control, operating the cutting mechanism in the forward direction until the material is fully passed through the cutting mechanism or another jam is detected.

14. The method of claim 13, further comprising prompting a predetermined number of user-actuated directional operations of the cutting mechanism, and if the jam is not cleared, indicating to the user that the jam must be manually cleared.

15. The method of claim 12, further comprising providing continuous illumination of lighting associated with the reverse direction control during the predetermined period of time, and flashing lighting associated with the forward direction control upon expiry of the predetermined period of time.

16. The method of claim 12, further comprising illuminating a jam icon and lighting associated with the reverse direction control to instruct the user to operate the reverse direction control.

17. The method of claim 16, further comprising flashing both the jam icon and lighting associated with the reverse direction control to instruct the user to operate the reverse direction control.

18. The method of claim 17, further comprising flashing both the jam icon and lighting associated with the forward direction control to instruct the user to operate the forward direction control.

19. The method of claim 12, wherein the jammed condition is identified by identifying a load on the cutting mechanism in excess of a threshold.

20. The method of claim 12, wherein the jammed condition is identified by concurrently identifying material presence and a load on the cutting mechanism below a threshold.

* * * * *